United States Patent [19]

Wallman

[11] 4,432,861

[45] Feb. 21, 1984

[54] FEED MIXING CHUTE AND PACKED BED FOR PYROLYZING HYDROCARBONACEOUS SOLIDS

[75] Inventor: P. Henrik Wallman, Berkeley, Calif.

[73] Assignee: Chevron Research Company, San Francisco, Calif.

[21] Appl. No.: 475,999

[22] Filed: Mar. 17, 1983

[51] Int. Cl.[3] ..... C10G 1/00

[52] U.S. Cl. ..... 208/11 R; 208/8 R

[58] Field of Search ..... 208/11 R, 8 R

[56] References Cited

U.S. PATENT DOCUMENTS

| | | | |
|---|---|---|---|
| 3,117,064 | 1/1964 | Friedrich | 208/11 R |
| 3,118,741 | 1/1964 | Faulk | 208/11 R |
| 3,597,347 | 8/1971 | Ellington | 208/11 |
| 3,703,442 | 11/1972 | Rammler et al. | 201/12 |
| 4,087,347 | 5/1978 | Langlois et al. | 208/11 |
| 4,227,990 | 10/1980 | Dearth et al. | 208/11 R |
| 4,312,740 | 1/1982 | Chiaramonte | 208/11 R |
| 4,332,669 | 6/1982 | Spars et al. | 208/11 |

*Primary Examiner*—Delbert E. Gantz
*Assistant Examiner*—Lance Johnson
*Attorney, Agent, or Firm*—D. A. Newell; S. R. LaPaglia; J. W. Ambrosius

[57] ABSTRACT

Particulate hydrocarbonaceous feed mixed with heat-transfer solids in chute with spouting gas and weir prior to introduction into packed bed for retorting.

7 Claims, 3 Drawing Figures

FEED MIXING CHUTE AND PACKED BED FOR PYROLYZING HYDROCARBONACEOUS SOLIDS

BACKGROUND OF THE INVENTION

Various methods have been proposed for pyrolyzing the hydrocarbonaceous fraction of certain naturally occurring materials, such as oil shale, coal, tar sands, diatomaceous earth, etc. For example, fluidized beds, partially fluidized beds, packed beds, and mechanical mixers have been suggested as a means for rapidly heating the hydrocarbonaceous materials to a pyrolyzing temperature. The use of a solid particulate heat-transfer material physically admixed with the hydrocarbonaceous material is one preferred method for raising the hydrocarbonaceous material to the desired temperature. Although advantageous, the use of a solid heat-transfer material requires that a practical commercial process be able to handle larger amounts of solids than otherwise would be required. This requirement, along with a need for rapid mixing, sufficient residence times for recovery of the pyrolysis products, and the ability to handle a diversity of particle sizes places stringent limitations on existing processes. For example, fully fluidized beds offer the advantage of rapid mixing of the solids in the bed to achieve thermal equilibrium between the hydrocarbonaceous material and the heat-transfer solid. However, the rapid top-to-bottom mixing characteristic of fluidized beds also makes it difficult to control the residence time of solids passing through the bed. It is desirable to achieve substantial plug flow conditions in the bed by limiting gross overall mixing of the solids. Such a condition is more characteristic of packed beds than of fluidized beds. However, packed beds have very poor mixing of the solids and tend to form "hot" and "cold" spots in the bed dependent upon the distribution of the heat-transfer solid. Thus, if a packed bed is used to pyrolyze the solid, some means for premixing the solids must be employed prior to introducing them into the packed bed.

SUMMARY OF THE INVENTION

The invention relates to a process for retorting a particulate hydrocarbonaceous solid which comprises:

(a) feeding the hydrocarbonaceous solid and a hot heat-transfer solid into the upper portion of a chute having an angle from the horizontal which exceeds the angle of slide of the mixture of solids and having at least one weir in the path of flow for the solids to control the depth of solids in the chute;

(b) passing on the upstream side of the weir an inert spouting gas across the path of flow for the mixture of solids in the chute at a rate sufficient to form locally a fluidized mixture of heat-transfer solids and hydrocarbonaceous solids;

(c) introducing the mixture of heat-transfer solids and particulate hydrocarbonaceous solids into a moving vertical packed bed and retorting said mixture therein for a time sufficient to pyrolyze a substantial amount of the hydrocarbons to release product vapors; and (d) separately recovering product vapors and pyrolyzed solids from the packed bed.

The hydrocarbonaceous solid may be any particulate material which may be pyrolyzed to yield useful products. The process disclosed herein is particularly useful for pyrolyzing naturally occurring materials containing hydrocarbons which decompose on heating to form hydrocarbonaceous gases or oils for use as petroleum feedstocks or as a fuel. Such materials include oil shale, coal, tar sands and diatomaceous earth. The process is especially advantageous for pyrolyzing oil shale because the heat-transfer material may be derived from the inorganic residue that remains after pyrolysis and/or combustion of the shale.

The heat-transfer solid is a particulate material such as sand, recycled oil shale residue, ceramic materials, ores, etc., which may be heated to a desired temperature and mixed with the carbonaceous solid to raise it to pyrolyzing temperature. The heat-transfer solid selected for use in the process is not usually critical, but it should be readily available in sufficient quantities to satisfy the needs of the process and be relatively stable at temperatures used in carrying out the pyrolysis. In the case of oil shale, recycled oil shale residue is a preferred heat-transfer material. However, with rich shales, the residue is highly prone to attrition resulting in a largely pulverulent residue. In this case, a small amount of lean shale or overburden material may be fed to the process to supply a coarser heat-transfer material.

The minimum angle of the chute from the horizontal will vary depending upon the particle size of the feed, its flow characteristics, presence of fines, velocity of the gas in the chute, etc. In general, the chute must be placed at an angle steep enough to keep the solids moving without choking the chute. However, the angle should not be so steep that the solids have an insufficient residence time to accomplish the necessary mixing and heat-transfer. Generally, the chute angle should be less than the angle of internal friction of the material. In the case of oil shale, the angle of inclination will usually fall within the range of about 30° to about 60°.

One or a plurality of weirs of suitable height are located in the path of flow of the solids in the chute for the purpose of damming up the solids to a preselected height. Gas inlet slots are located on the upstream side of each weir for the purpose of introducing a "spouting gas" at these locations. As used herein the term "spouting gas" refers to a gas jet having a sufficient velocity to locally fluidize the majority of the solids above the gas inlet slots. This fluidized region has the form of a spout with solids moving generally in an upward direction. The purpose of the spouted region is to mix the heat transfer solids with the hydrocarbonaceous feed solids. The spouted region also serves to move the solids in a fluidized state from the bottom of the chute to the top of the bed and over the weir. The spouting gas will also decrease the angle of slide of the solids in the chute. The angle of slide is defined as the minimum angle at which a material will flow from rest on an inclined surface. The spouting gas should be a non-oxidizing gas such as steam, recycle retort gas, natural gas, nitrogen, carbon dioxide, etc.

DETAILED DESCRIPTION OF THE INVENTION

The present invention may be more clearly understood by reference to the drawings which illustrate a retorting system for recovering shale oil from oil shale. With appropriate modification, the retorting system may also be used to pyrolyze other hydrocarbonaceous materials.

Figure 1:
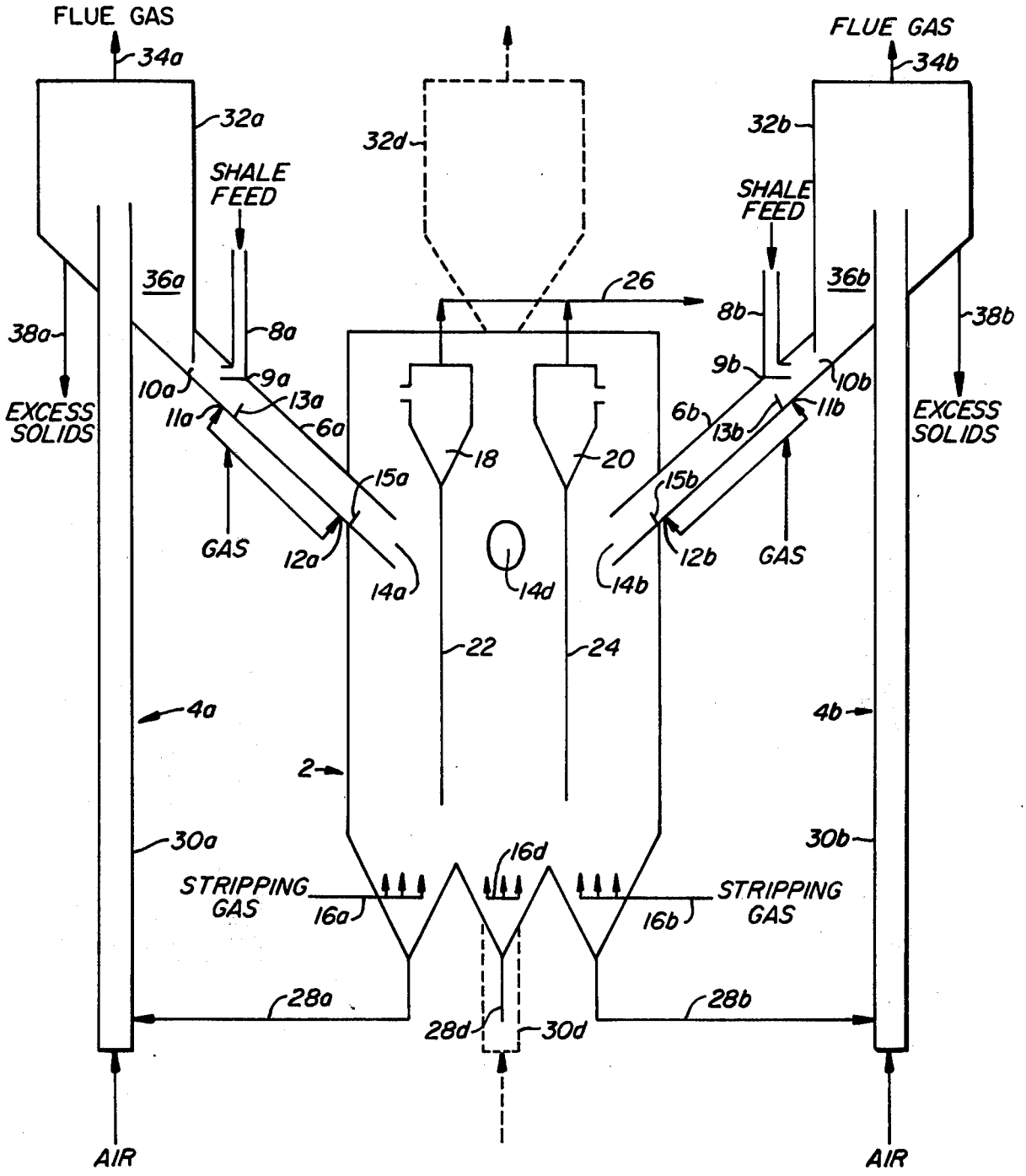
FIG. 1 is a diagram of a retort and combustor system, shown from the side, which could be used in carrying out the process of the invention.
Figure 2:
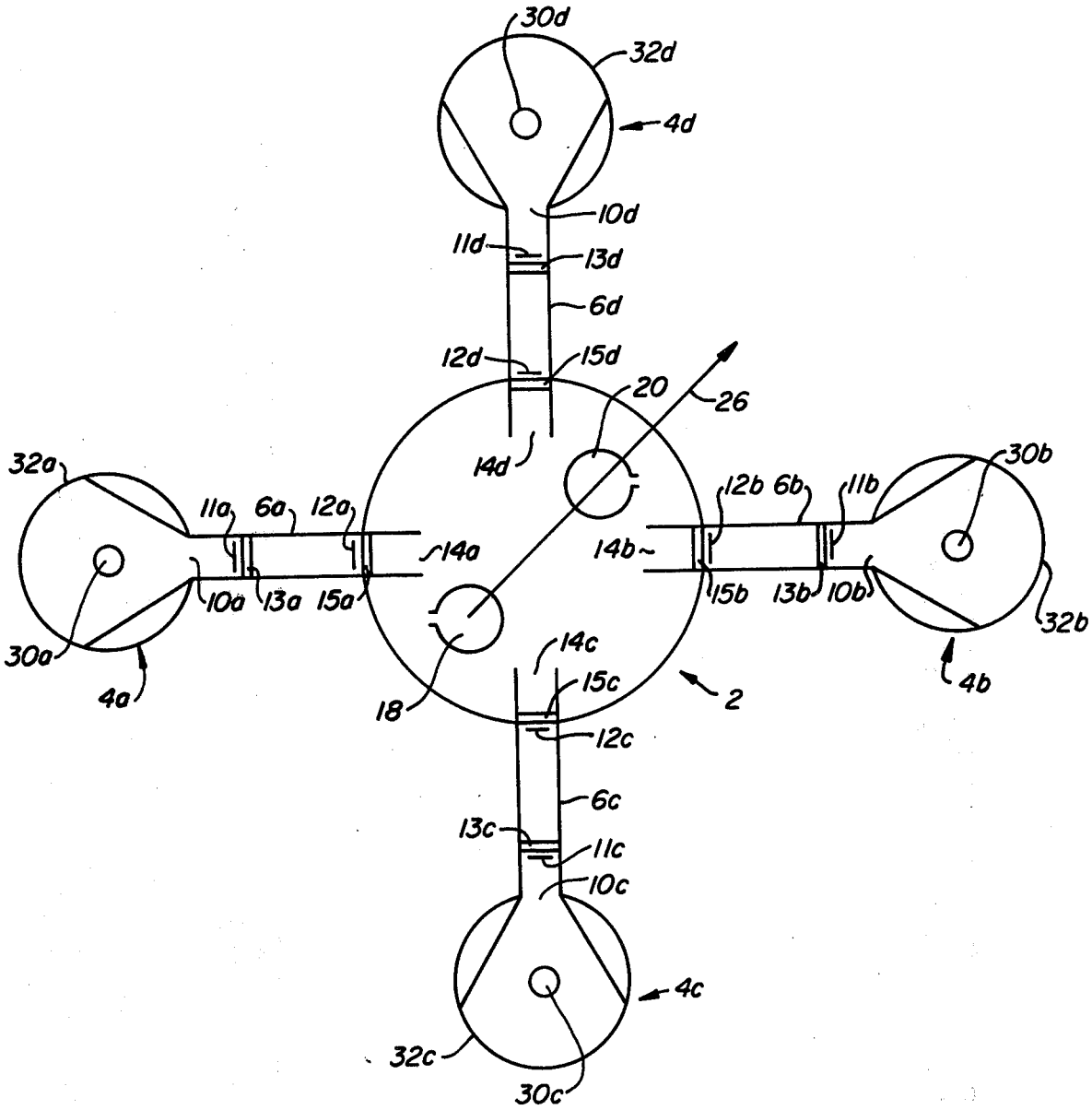
FIG. 2 is a top view of the system of FIG. 1 which illustrates the arrangement of combustors relative to the retort.

Referring to FIG. 1, shown is a central retorting vessel 2. The retorting vessel is surrounded by combustors, two of which are indicated as 4*a* and 4*b* in FIG. 1. In FIG. 2, all four combustors 4*a*, 4*b*, 4*c*, and 4*d* are shown. Each of the four combustors are connected to the retorting vessel by a chute which is designated as 6*a*, 6*b*, 6*c*, or 6*d*, respective to its combustor.

In operation, fresh shale, after being reduced to a maximum particle size of about ½ inch, is fed via raw shale feed pipes 8*a* and 8*b* and via L-valves 9*a* and 9*b* into the upper end of chutes 6*a* and 6*b*, respectively. Raw shale feed pipes corresponding to 8*c* and 8*d* and to L-valves 9*c* and 9*d* are not shown, but would be present. In the chute, the raw shale flows cocurrent with hot heat-transfer solids entering the chutes from the combustors via inlets 10*a*, 10*b*, 10*c*, and 10*d*. A spouting gas is introduced through gas inlet slots 11*a*, 11*b*, 11*c* and 11*d* located in the upper portion of each chute. A second gas inlet slot is located in the lower portion of each chute, designated as 12*a*, 12*b*, 12*c*, and 12*d*, respectively. An upper weir and a lower weir are located downstream from each gas inlet slot and are designated as 13*a*, 13*b*, 13*c*, 13*d* and as 15*a*, 15*b*, 15*c* and 15*d*, respectively. As the raw shale and hot heat-transfer solids flow down the chute some mixing occurs, although particles on the bottom of the moving bed remain largely on the bottom, and particles on the top remain on the top. Some mixing of the solids will occur at intermediate levels. However, at the spouting slots intense mixing occurs because of the fluidized state resulting from the gas jets. The mixture of recycle and fresh particles flow over the weir in a fluidized state and is again defluidized downstream of the weir.

The residence time of the solids in the chute is preferably between about 10 seconds and 120 seconds—sufficient time to effect substantial mixing and to approach thermal equilibrium.

The hot solids mixture drops out of the openings from the various chutes, shown as 14*a*, 14*b*, 14*c*, and 14*d*, respectively, onto the top of a moving packed bed of solids contained in the retorting vessel 2. In the retorting vessel, the hot solids are retained in the retorting vessel for a time sufficient to pyrolyze a significant fraction, preferably all, of the hydrocarbons in the feed. Final temperature equilibrium between the feed solids and the heat-transfer solids occurs in the top of the packed bed through heat convection and conduction. A stripping gas, usually containing steam or other inert gas, is introduced into the bottom of the retort via stripping gas inlets 16*a*, 16*b*, and 16*d*, (16*c* is not shown) to aid in carrying away evolved product vapors. The product vapors, stripping gas, spouting gas, and entrained fine solids are carried up to the top of the retorting vessel and enter either of cyclones 18 or 20 where fine solids are removed from the gases and returned to the bed of solids via diplegs 22 and 24. Alternatively, cyclones 18 and 20 can also be external to retorting vessel 2. The gases leave the cyclones and the retorting vessel via gas outlet 26. The gases pass to a separation zone (not shown) where the product vapors are recovered as shale oil.

The mixture of heat-transfer solid and pyrolyzed oil shale containing a carbonaceous residue is removed from the bottom of the retorting vessel and the packed bed via L-valves 28*a*, 28*b*, and 28*d* (28*c* is not shown in the diagrams). The solids mixture is introduced into the bottom of the liftpipe portions 30*a*, 30*b*, 30*c* and 30*d* of the combustors. The solids are entrained in a stream of air, ignited, at least partially burned, and carried to the upper disengaging sections 32*a*, 32*b*, 32*c*, and 32*d* of the combustors. Flue gases leave the combustors via flue gas outlets 34*a* and 34*b* (34*c* and 34*d* are not shown). Any carbonaceous residue remaining in the solids is burned in the upper disengaging area. The hot burned solids are collected in the bin area 36*a* and 36*b* (36*c* and 36*d* are not shown) of the combustor and either recycled to the chute as heat-transfer material or recovered via outlets 38*a* and 38*b* (38*c* and 38*d* are not shown) as excess solids.

Figure 3:
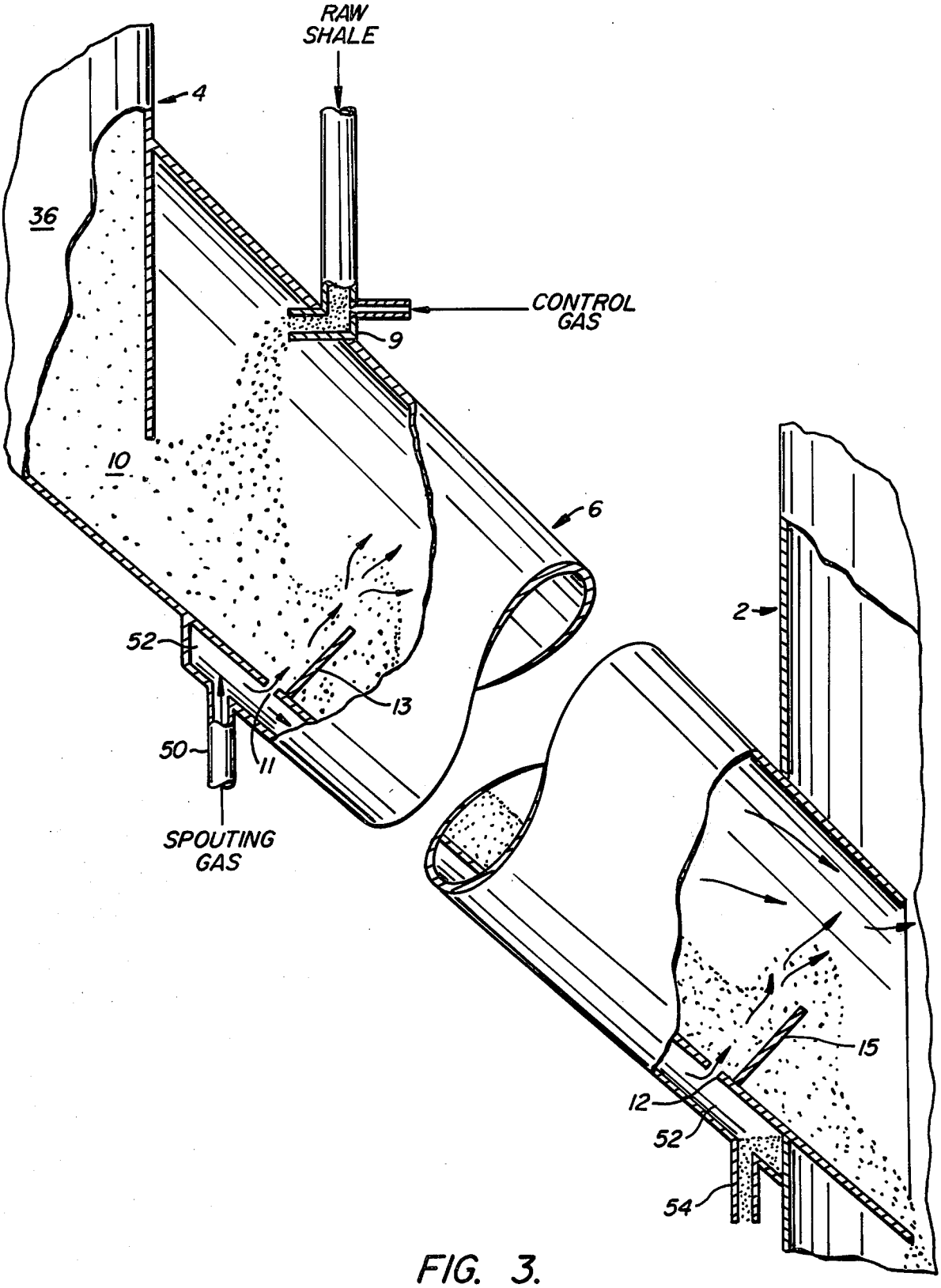
FIG. 3 is a more detailed view partially cut away of the mixing chute used in FIGS. 1 and 2.

FIG. 3 illustrates in detail the operation of the feed mixing chute. The hot burned solids in the bin area 36 of the combustor 4 flow into the chute 6 by way of inlet 10. Raw oil shale reduced to a maximum particle size of about ½ inch enters the chute through L-valve 9 into which a control gas is injected to act as a gas seal and to control the feed rate. An upper weir 13 maintains the solids entering the chute at a predetermined level by damming up the flow as the solids move down the chute. A spouting gas introduced through gas inlet pipe 50 enters gas distribution chamber 52 and is distributed to spouting slots 11 and 12. The gas leaves the spouting slots at a velocity sufficient to fluidize the particles and mix the hot heat transfer solid and raw shale. The fluidized and mixed material readily flows over the upper weir and down the mid-portion of the chute. Since the chute is inclined at an angle which exceeds the angle of slide, the solids will move down the mid-portion of the chute. The level of the moving bed is set by the level of the lower weir 15. Spouting gas entering through inlet slot 12 accomplishes the final mixing of the solids. The mixing that takes place in the fluidized region above spouting slot 12 produces a close approach to thermal equilibrium between the particles before they enter the packed bed in the retorting vessel 2. A solids drain 54 is provided at the bottom of the gas distribution chamber to recover solids which drop accidentally through the spouting gas slots at startup or shutdown.

In the case of oil shale having a maximum particle size of about ½ inch, the angle of slide on stainless steel is about 30° and the angle of internal friction about 60°. A suitable chute angle is about 45° to allow high solids throughputs and to insure that no stoppages occur in the flow of the solids. A particular design like the one in FIG. 3 will have the following dimensions and parameters:

Chute Diameter: 6 feet
Chute Length: 30 feet
Width of Bed Support Plate: 4 feet
Weir Height: 16 inches
Number of Weirs (Spouting Slots): 2
Spouting Slot Geometry: ½ inch×4 feet
Slot Gas Velocity: 200 feet/sec
Total Gas Rate: 10,000 lb/hr
Solids Rate: 1,000,000 lb/hr
Solids Residence Time: 1 minute In the case of oil shale, decomposition of the kerogen occurs at temperatures in excess of about 400° F. For practical retorting processes, the pyrolyzing temperatures are usually much higher, generally falling within the range of from about 850° F. to 1000° F. At temperatures above 1000° F., undesirable thermal cracking of the shale oil vapor takes place resulting in a significant oil yield loss due to production of light hydrocarbon gases and associated coke formation. The temperature to which the recycle material is heated prior to introduction into the feed chute depends upon a number of factors such as the ratio of heat carrier to raw oil shale, the grade of the raw oil shale, the coke yield in the retort, and the efficiency of the combustion. Generally, the temperature of heat carrier particles is in the range of from about 1100° F. to about 1600° F. at the time it enters the retorting vessel. In carrying out the present invention, a recycle ratio in the range of about 1 to about 5 (recycle/raw shale) is usually employed with a ratio in the range of from about 2 to 3 being preferred.

The design of the mixing chute will depend on a number of factors. The chute may be of circular, ellipsoidal or rectangular cross-section. For the purpose of simplicity only, a chute of circular cross-section is discussed, but similar design criteria hold for other cross-sectional shapes.

A general design criterion is to keep the volume of solids in the chute below 50% of the total chute volume, typically around 25%. This is achieved by a weir size no greater than 50%, preferably 25% of the cross-section of the chute. A sufficiently large "empty" space must be provided above the bed of solids in the chute to allow for gas flow down the chute and for splashing of solids above the spouting slots. Generally, the more solids in the chute, i.e. the deeper the bed of solids, the more gas is required for efficient mixing in the spouted regions. The higher gas rates required for deeper beds translate either into higher slot velocities or into larger slots. In either case, the spouted region should expand upward to reach the top of the bed.

The spouting gas rate should be high enough to move solids near the bottom of the moving packed bed up into the spouted region and over the weir. This minimum spouting gas rate depends on bed depth and solid characteristics such as density and particle size distribution. The maximum gas rate is set by the rate at which the jet penetration length equals the bed depth. Above this maximum gas rate, attrition of particles and erosion of both the weir and the chute ceiling become unacceptably high.

Gas inlet geometry will have to be determined in each application individually. In a circular chute the bed of solids may be supported by a plate which also acts as a gas distributor. The gas inlet slots extend across the width of the support plate. For rectangular chutes, the gas inlet slots simply extend across the bottom of the chute. The width of the slot is then determined based on the desired slot gas velocity and the required gas rates set by the desired mixing efficiency. Generally the gas velocity is between 100 and 500 ft/sec in the slot. Higher gas velocities give higher pressure drops through the slots and therefore, better gas distribution in the slot and between several slots if the slots are manifolded to one gas source. However, higher slot velocities also result in higher attrition of particles in the gas jet immediately above the slot.

The number of spouting slots is also a function of the general design parameters. Generally, the larger the throughput of solids in the chute, the more slots are required to accomplish the mixing. For small throughputs and small chutes, one slot is sufficient. But generally, two slots will be required: one at the entrance to accomplish initial mixing for quick quenching of the hot recycle solids, and one at the exit to accomplish final mixing before dumping of the solids mixture into the packed bed retort.

Although the above discussion, makes reference only to the use of slots in the bottom of the chute to distribute gas, one skilled in the art will rocognize that other means, while less preferable, may also be used to introduce the spouting gas. For example, perforations, nozzles, etc. may also be employed and may have advantages under certain circumstances.

What is claimed is:

1. A process for retorting a particulate hydrocarbonaceous solid which comprises:

(a) feeding the hydrocarbonaceous solid and a hot heat-transfer solid into the upper portion of a chute having an angle from the horizontal which exceeds the angle of slide of the mixture of solids and having at least one weir in the path of flow for the solids to control the depth of solids in the chute;

(b) passing on the upstream side of the weir an inert spouting gas across the path of flow for the mixture of solids in the chute at a rate sufficient to form locally a fluidized mixture of heat-transfer solids and hydrocarbonaceous solids;

(c) introducing the mixture of heat-transfer solids and particulate hydrocarbonaceous solids into a moving vertical packed bed and retorting said mixture for a time sufficient to pyrolyze a substantial amount of the hydrocarbons to release product vapors; and (d) separately recovering product vapors and pyrolyzed solids from the packed bed.

2. The process of claim 1 wherein the hydrocarbonaceous solid is oil shale.

3. The process of claim 2 wherein the heat-transfer solid contains recycled oil shale residue.

4. The process of claim 1 wherein the angle of the chute from the horizontal is between about 30° and 60°.

5. The process of claim 1 wherein the volume of solids in the chute is not in excess of 50%.

6. The process of claim 1 wherein the ratio of heat-transfer solid to hydrocarbonaceous solid is in the range of from 2 to 5.

7. The process of claim 1 wherein the velocity of the spouting gas introduced into the chute is between about 100 and 500 feet/sec.

* * * * *